US006104892A

United States Patent [19]

Kobayashi et al.

[11] Patent Number: 6,104,892

[45] **Date of Patent: *Aug. 15, 2000**

[54] DEVELOPING DEVICE AND IMAGE FORMING APPARATUS

[75] Inventors: Yoshiaki Kobayashi, Numazu; Masaru Hibino, Minami Ashigara; Masanori Shida, Shizuoka-ken; Ichiro Ozawa, Funabashi, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 09/323,994

[22] Filed: Jun. 2, 1999

[30] Foreign Application Priority Data

Jun. 8, 1998 [JP] Japan ..... 10-175397
Aug. 13, 1998 [JP] Japan ..... 10-242542

[51] Int. Cl.[7] ..... G03G 15/06

[52] U.S. Cl. ..... 399/63; 399/62

[58] Field of Search ..... 399/30, 61, 62, 399/63, 267, 272, 275, 277, 265

[56] References Cited

U.S. PATENT DOCUMENTS

| | | | |
|---|---|---|---|
| 4,660,505 | 4/1987 | Goto et al. | 399/277 X |
| 4,868,601 | 9/1989 | Morimoto et al. | 399/63 |
| 4,891,675 | 1/1990 | Asanuma | 399/63 |
| 4,924,270 | 5/1990 | Sako et al. | 399/63 |
| 4,980,728 | 12/1990 | Funayama et al. | 399/277 X |
| 5,237,372 | 8/1993 | Ishii et al. | 399/30 |
| 5,310,425 | 5/1994 | Nakagawa et al. | 399/62 X |
| 5,576,812 | 11/1996 | Hibino, et al. | 399/267 |
| 5,722,002 | 2/1998 | Kikuta et al. | 399/30 |
| 5,870,656 | 2/1999 | Hibino, et al. | 399/149 |

FOREIGN PATENT DOCUMENTS

| | | |
|---|---|---|
| 55-32060 | 3/1980 | Japan . |
| 59-165082 | 9/1984 | Japan . |
| 7-222002 | 8/1995 | Japan . |

*Primary Examiner*—Susan S. Y. Lee
*Attorney, Agent, or Firm*—Fitzpatrick, Cella, Harper & Scinto

[57] ABSTRACT

A developing device having a developer bearing member for carrying thereon a developer having toner and carrier and conveying the developer to a developing area, an agitating member for agitating the developer, a rotation radius R (m) of the agitating member being $5.0\times10^{-3}$ (m)<R<$8.0\times10^{-3}$ (m), and a density sensor for detecting a density of the toner in the developer, the density sensor detecting any change in the density of the toner as a change in a magnetic permeability of the developer, wherein when a shortest distance between an outermost surface of the agitating member and a detecting surface of the sensor is defined as Dmin (m) and a half length of the detecting surface of the sensor in a plane perpendicular to a rotary axis of the agitating member is defined as r, 0 (m)<Dmin<$1.0\times10^{313}$ (m) and 0.4<r/R<0.75.

25 Claims, 9 Drawing Sheets

DEVELOPING DEVICE AND IMAGE FORMING APPARATUS

BACKGROUND OF THE INVENTION

1. Field of the Invention

This invention relates to an image forming apparatus such as a copying apparatus, a printer, a recorded image displaying apparatus or a facsimile apparatus for developing an electrostatic latent image formed on an image bearing member by an electrophotographic system or an electrostatic recording system or the like and forming a visible image, and to a developing device of the image forming apparatus.

2. Related Background Art

There is known a developing device in which a dry type developer as a visualizing agent is carried on a surface of a developer bearing member and this developer is conveyed and supplied to the vicinity of the surface of an image bearing member bearing an electrostatic latent image thereon, and the electrostatic latent image is developed into a visible image while an alternating electric field is applied to between the image bearing member and the developer bearing member.

A developing sleeve is generally often used as the developer bearing member and therefore, the developer bearing member will hereinafter be referred to as the "developing sleeve", and a photosensitive drum is generally often used as the image bearing member and therefore, the image bearing member will hereinafter be referred to as the "photosensitive drum".

As the developing method, there is known the so-called magnetic brush developing method comprising forming a magnetic brush on the surface of the developing sleeve having a magnet disposed therein by a developer (two-component developer) composed, for example, of two-component based composition (carrier particles and toner particles), causing this magnetic brush to rub with or be proximate to the photosensitive drum opposed to the developing sleeve with a minute developing gap held therebetween, and continuously applying an alternating electric field to between the developing sleeve and the photosensitive drum (between S–D) to thereby repetitively effect the transference of the toner particles from the developing sleeve side to the photosensitive drum side and the counter-transference to effect development. (See, for example, Japanese Patent Application Laid-Open No. 55-32060 and Japanese Patent Application Laid-Open No. 59-165082).

A developing device for the above-described two-component magnetic brush development is provided with a developing container comparted into a developing chamber and an agitating chamber by a partition wall, and agitating and conveying screws which are agitating members are rotatably contained in the developing chamber and the agitating chamber. In the opening portion of the developing chamber, a developing sleeve rotated in a predetermined direction is disposed in opposed relationship with a photosensitive drum rotated in a predetermined direction, with a minute spacing therebetween, and a magnet is fixedly disposed in the developing sleeve.

A developer comprising a mixture of toner particles and magnetic carriers is contained in the developing container, and the mixture ratio (hereinafter referred to as the "T/C ratio") of the toner particles and the magnetic carriers is kept constant by an amount of toner corresponding to the toner consumed by development being dropped and supplied from a toner storing chamber in which a toner for replenishment is contained.

The dropped and supplied toner is agitated with the developer in the developing container by the screw in the agitating chamber and conveyed. The supplied toner is conveyed along the lengthwise direction of the container conversely to the direction of conveyance of the developer by the conveying screw in the developing chamber. Openings are formed in this side and the inner side of the partition wall, and the delivery of the developer is effected in this opening portion.

Now, the maintenance of the mixture ratio of the toner particles and magnetic carriers of the two-component developer in the developing container is very important for the stabilization of an output image, and various types of methods of detecting and maintaining it have heretofore been proposed. There have been proposed and put into practical use, for example, a method of a type in which detecting means is provided around a photosensitive drum and light is applied to a developed toner image on the photosensitive drum and from the transmitted light or the reflected light at this time, the amount of toner supply is adjusted and as the result, the T/C ratio is detected, a method of a type in which detecting means is provided near a developing sleeve and the T/C ratio is detected from the reflected light when light is applied to a developer applied onto the developing sleeve, and a method of a type in which a sensor is provided in a developing container and by the utilization of the inductance of a coil, an apparent change in the magnetic permeability of the developer in a predetermined volume near the sensor is detected to thereby detect the T/C ratio.

However, the method of the type in which the T/C ratio is maintained from the amount of developing toner on the photosensitive drum suffers from the problem that for example, by the fluctuation of the gap between the photosensitive drum and the developing sleeve, the potential of a latent image or the like, the amount of developing toner fluctuates independently of the T/C ratio of the developer in the developing container and as the result, the proper supply of the toner becomes impossible, and the method of the type in which the T/C ratio is detected from the reflected light when light is applied to the developer applied onto the developing sleeve suffers from the problem that an accurate T/C ratio cannot be detected when the surface of the reflected light detecting means is stained by the scattering of the toner occurring when the charging amount of the toner is reduced under high humidity environment or the like.

In contrast with these, the method of the type in which by the utilization of the inductance of the coil, the variation in the magnetic permeability of the developer in a predetermined volume near the sensor is detected to thereby detect the T/C ratio (hereinafter referred to as the "inductance detecting sensor") is low in the cost of the sensor and in addition, is scarce in the wrong detection as described above and can accurately detect the T/C ratio of the developer.

The inductance detecting sensor is disposed near a screw, and on the basis of such a sequence that when for example, the magnetic permeability of the developer in a predetermined volume becomes great, it judges that the T/C ratio of the developer has become low, and starts the supply of the toner, and when conversely the magnetic permeability becomes small, it judges that the T/C ratio of the developer has become high, and stops the supply of the toner, it controls the T/C ratio of the developer.

In recent years, in image forming apparatuses, and particularly full color copying apparatuses, the downsizing of the apparatus has been required and along therewith, developing devices are in a situation wherein they must pursue further downsizing. As the result, they must use not only developing containers, but also developing sleeves and agitating members which are downsized, and form apparatuses of as high reliability as before.

On the other hand, the above-described inductance detecting sensor detects any change in the magnetic permeability of the developer in a predetermined volume and therefore, there arises the problem that when there is a fluctuation of the bulk density of the developer by being left as it is or the fluctuation or the like of the environment, it judges that the magnetic permeability differs in spite of the same T/C ratio and therefore, in order to cope with such problem, this sensor is usually disposed near the agitating member by which the developer is stably circulated and flows.

At this time, the following problem may arise depending on the relation among the agitating member of a small diameter and the bulk height of the developer, and the shape and size of the sensor.

When as shown in FIG. 10 of the accompanying drawings, the size of the detecting surface of a sensor 110, e.g. the diameter thereof when the detecting surface is substantially circular, is considerably large relative to the rotation diameter of an agitating member 105 and a developing container substantially along the curvature thereof, there are formed spaces as indicated by hatched portions c and d in the gap between the sensor 110 and the agitating member 105.

When in the presence of such spaces, the developer is agitated in the developing container 101, the developer which has come into the spaces indicated by the hatched portions c and d, particularly in the portion c, is not conveyed by the agitating member 105 but stagnates.

It is chiefly the developer in a hatched portion e circulated in the developing container 101 by the agitating member 105 that the T/C ratio of the developer varies for the consumption and supply of the toner by the developing operation and therefore, the developer present in the spaces indicated by the hatched portions c and d wherein the developer stagnates, particularly in the portion c, is very small in the fluctuation of the T/C ratio.

If in this state, an attempt is made to detect the T/C ratio by the inductance detecting sensor 110, the stagnant developer in the hatched portions c and d wherein the change in the T/C ratio of the developer is small is also detected with the developer in the hatched portion e wherein the T/C ratio fluctuates and therefore, there cannot be obtained the output value of the toner density detecting sensor 110 which accurately corresponds to the T/C ratio.

In FIG. 11 of the accompanying drawings, a straight line X shows the relation of the output value of the toner density detecting sensor to the T/C ratio of the developer. The straight line X is an ideal line.

The relation of this straight line X is an ideal state, and even when the consumption and supply of the toner are effected from the center T/C ratio, an error will occur to the amount of toner supply unless the T/C ratio shifts on the straight line X. In contrast, a straight line Y in FIG. 11 shows a variation in the output value of the inductance detecting sensor when the above-mentioned spaces are present and the consumption and supply of the toner are actually effected. From the straight line Y, it will be seen that when the T/C ratio becomes low, the output of the inductance detecting sensor tends to become low as compared with the case of the straight line X, and when the T/C ratio becomes high, the output of the inductance detecting sensor tends to become high as compared with the case of the straight line X.

This is because even if the T/C ratio of the developer in the hatched portion e circulated in the developing container is reduced, the stagnant developers in the hatched portions c and d remains approximate to the center T/C ratio and as the result, the inductance detecting sensor detects both of the developers low in the T/C ratio and therefore, the output value becomes low relative to the output value for the straight line X and even if conversely the T/C ratio of the developer in the hatched portion e rises, the stagnant developers in the hatched portions c and d remain approximate to the center T/C ratio and therefore, the inductance detecting sensor detects both of the developer high in the T/C ratio and the developer of the center T/C ratio and therefore, the output value becomes high relative to the output value for the straight line X.

For the reason set forth above, there cannot be obtained the output value of the inductance detecting sensor which accurately corresponds to the T/C ratio, and if in this case, the stagnant developers in the hatched portions c and d do not move, the sensor sensitivity (the amount of change in the output of the sensor for a change of 1% in the T/C ratio) drops, but if the output value of the inductance detecting sensor for a change in the T/C ratio changes always on the straight line Y, the change in the T/C ratio can be sufficiently detected.

However, when the stagnant developers move due to the vibration of the copying apparatus itself, the vibration of the developing device by the copying operation, a change in the fluidity of the developer, a change in the bulk density of the developer, etc., the T/C ratio following line Y is not reproduced.

When conversely, the size of the detecting surface of the sensor, e.g., the diameter thereof when the detecting surface is substantially circular, is considerably small relative to the rotation diameter of the agitating member and the container substantially along the curvature thereof, the above described problem of dead space is solved, but first, there arises the problem of a reduction in the absolute output of the sensor. This reduction in the absolute output can be prevented by improving members such as a coil and a core in the sensor, but in that case, an increase in cost results. Also, if the detecting area of the sensor becomes small, the possibility of detecting a local change in the magnetic permeability of the developer in the developing container (for example, the developer locally including the coagulated toner) becomes high and as the result, again in this case, a wrong toner supplying operation will occur.

Also, the wrong detection by the inductance detecting sensor may also occur from the relation between the bulk height of the developer present in the portion wherein the agitating member is disposed and the location at which the sensor is disposed. This is liable to occur particularly when the sensor is disposed on the side wall surface of the container near the agitating member. Usually, the bulk height of the developer (the surface of the developer) in the portion in an agitating chamber R2 wherein the agitating member is disposed is such that in order to satisfy good agitation, as shown in FIG. 12 of the accompanying drawings, about 75% to 90% of the outermost rotational surface of the agitating member is buried. If at this time, the sensor disposed on the wall surface on the side of the agitating member is too much above the rotational center axis of the agitating member, the uppermost surface of the sensor will be located above the uppermost surface of the developer and thus, there will occur the phenomenon that the detection output decreases sharply.

On the other hand, the developer present in the gap between the lower portion of the agitation member indicated by a hatched portion h in FIG. 12 and the inner wall surface near the bottom of the container is somewhat low in flow speed as compared with that in the upper portion, and is liable to stagnate particularly under high humidity environment. Again when the detecting surface of the sensor hangs over this portion, the accuracy of the output is reduced.

Consequently, it is desired to make the positional relation and the size relation between and the shapes of the small-diametered agitating member and the inductance detecting sensor and the gap therebetween proper.

SUMMARY OF THE INVENTION

It is an object of the present invention to provide a developing device and an image forming apparatus which can stably detect the density of a toner in a developer.

It is another object of the present invention to provide a developing device and an image forming apparatus which can be compatible in the downsizing of the device and apparatus and the improvement in the reliability of toner density detecting means.

It is still another object of the present invention to provide a developing device and an image forming apparatus in which the relation between a developer agitating member and toner density detecting means is optimized.

It is yet still another object of the present invention to provide a developing device and an image forming apparatus in which the detection accuracy of toner density detecting means can be improved.

Other objects and features of the present invention will become more fully apparent from the following detailed description when read with reference to the accompanying drawings.

DESCRIPTION OF THE PREFERRED EMBODIMENTS

A developing device and an image forming apparatus according to the present invention will hereinafter be described in greater detail with reference to the drawings. In the embodiments described hereinbelow, the present invention will be described as being embodied into an electrophotographic image forming apparatus as shown, for example, in FIG. 2, but is not restricted thereto.

Figure 2:
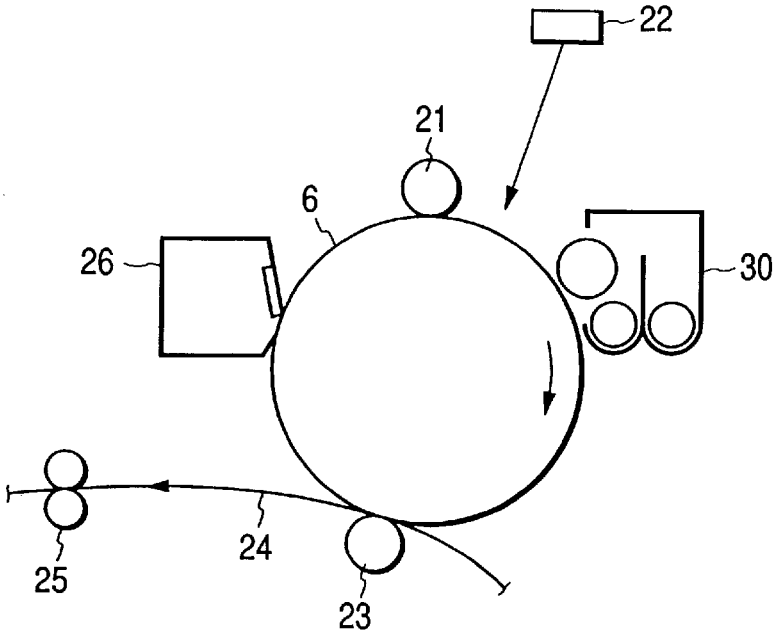
FIG. 2 schematically shows a construction of an example of an electrophotographic image forming apparatus to which the present invention is applied.

Referring to FIG. 2, the electrophotographic image forming apparatus is provided with a rotatable photosensitive drum 6 which is an image bearing member, and this photosensitive drum 6 is uniformly charged by a primary charger 21, and then an information signal is exposed by a light emitting element 22 such as a laser to thereby form an electrostatic latent image, which is then made into a visible image by a developing device 30. Next, this visible image is transferred to transfer paper 24 by a transfer charger 23, and the transferred image is fixed by a fixing device 25 to thereby obtain a permanent image. Also, any untransferred toner on the photosensitive drum 6 is removed by a cleaning device 26.

[First Embodiment]

A first embodiment of the present invention will now be described with reference to FIGS. 1 and 3 to 5.

Figure 1:
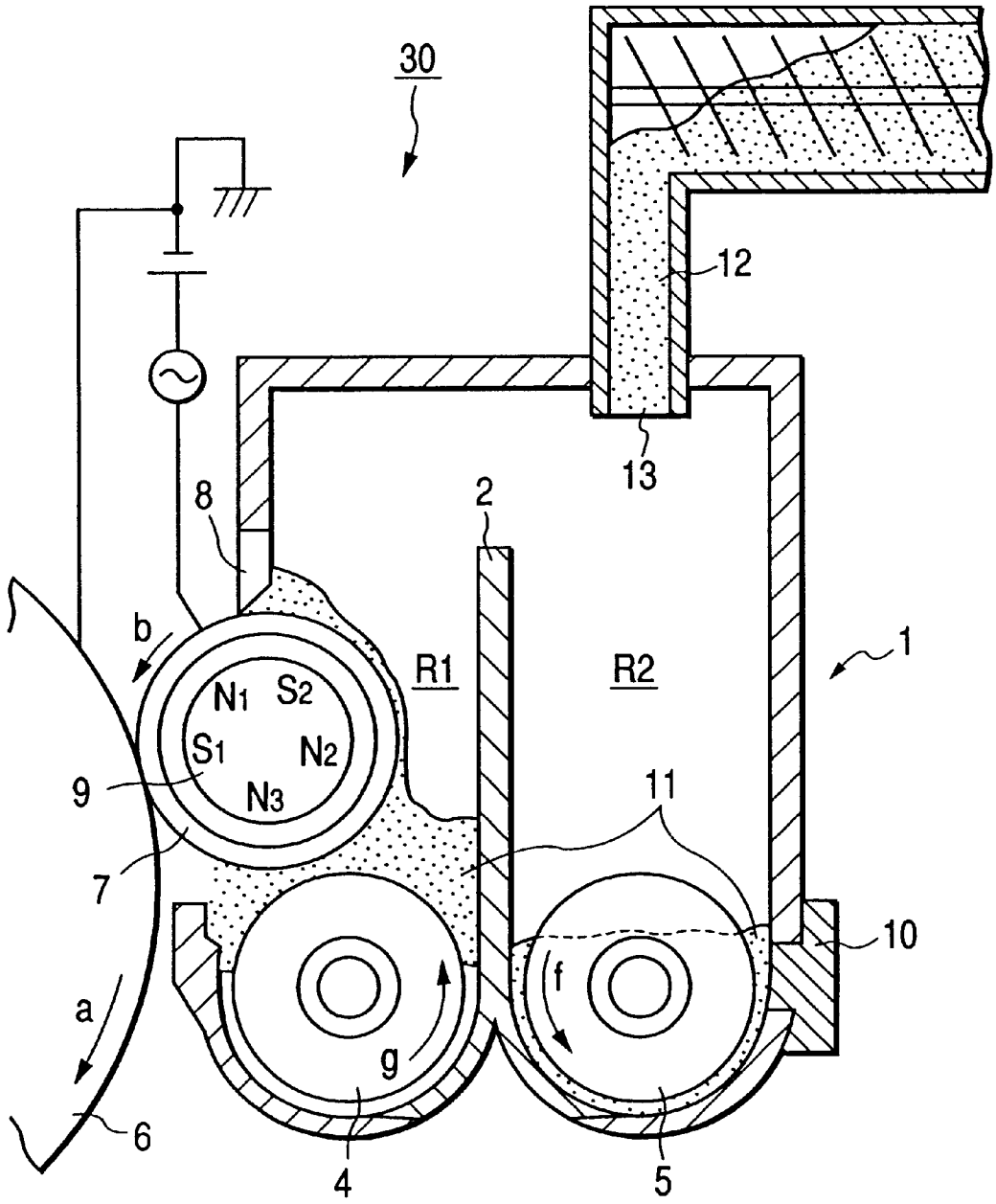
FIG. 1 shows a construction of an example of a developing device to which the present invention is applied.

Referring to FIG. 1, the developing device 30 is provided with a developing container 1, the interior of which is comparted into a developing chamber R1 and an agitating chamber R2 by a partition wall 2, and a toner storing chamber, not shown, is provided above the agitating chamber R2 and a toner 12 to be supplied is contained therein. An amount of toner 12 corresponding to the toner consumed by development drops from a supply port 13 in the lower portion of the toner storing chamber into the agitating chamber R2. On the other hand, a developer 11 comprising a mixture of the toner particles and magnetic carriers is contained in the developing chamber R1 and the agitating chamber R2.

A spirally shaped first screw (agitating member) 4 having a function excellent in developer agitation and conveyance is contained in the developing chamber R1, and is rotatively driven to thereby convey the developer along the lengthwise direction of a developing sleeve 7 which is a developer bearing member.

A spirally shaped second screw (agitating member) 5 is likewise contained in the agitating chamber R2, and the direction of conveyance of the developer by the second screw 5 is opposite to that by the first screw 4. Openings, not shown, are formed in this side and the inner side of the partition wall 2, and the developer 11 conveyed by the first screw 4 is delivered from one of these openings, to the second screw 5, and the developer 11 conveyed by the second screw 5 is delivered from the other opening to the first screw 4.

Also, an opening portion is provided at that region of the developing container 1 which is proximate to the photosensitive drum 6, and in this opening portion, there is provided the developing sleeve 7 formed of a material such as aluminum or non-magnetic stainless steel and having moderate unevenness on the surface thereof.

In the present embodiment, the developing sleeve 7 is rotated at a peripheral velocity Vb in the direction of arrow b (the same direction as the direction of rotation of the photosensitive drum), and is regulated into a proper developer layer thickness by a layer thickness regulating blade 8 provided on the upper end of the opening portion of the developing container 1, and thereafter bears and conveys the developer to a developing area. The magnetic brush of the developer borne on the developing sleeve 7 contacts with the photosensitive drum 6 rotated at a peripheral velocity Va in the direction of arrow a in the developing area, and the electrostatic latent image is developed in this developing area. The peripheral velocity Vb of the developing sleeve 7 may desirably be 130% to 200% relative to the peripheral velocity of the photosensitive drum, and more desirably be 150% to 180%. Below the above-mentioned range, sufficient image density is not obtained, and above it, the scattering of the developer occurs.

A magnet 9 which is roller-shaped magnetic field producing means is fixedly disposed in the developing sleeve 7. This magnet 9 has a developing magnetic pole S1 opposed to the developing area. The magnetic brush of the developer is formed by a developing magnetic field formed in the developing area by the developing magnetic pole S1, and this magnetic brush contacts with the photosensitive drum 6 to thereby develop the electrostatic latent image. At that time, the toner adhering to the magnetic brush and the toner adhering to the surface of the sleeve transfer to the image area of the electrostatic latent image and develop it. In the present embodiment, the magnet 9 has, besides the above-mentioned developing magnetic pole S1, magnetic poles N1, N2, N3 and S2.

By such a construction, the developer applied to the poles N2 and S2 by the rotation of the developing sleeve 7 passes the layer thickness regulating blade 8 and comes to the developing magnetic pole S1, and the developer forming the magnetic brush in the magnetic field thereof develops the electrostatic latent image on the photosensitive drum 6. Thereafter, the developer on the developing sleeve 7 drops into the agitating chamber R1 by the repulsive magnetic field between the poles N2 and N3. The developer having dropped into the agitating chamber R1 is agitated and conveyed by the first and second screws 4 and 5.

An inductance detecting sensor 10 which is toner density detecting means in the present embodiment is disposed on a side of the agitating chamber R2 adjacent to the second screw 5, as shown in FIG. 1. In the side portion of the second screw 5, the flow speed of the developer is high and regular and stagnation is difficult to cause and therefore, if the inductance detecting sensor 10 is disposed in this portion, detection accuracy will become considerably higher than if it is disposed at any other portion in the developing container 1. At this inductance detecting sensor 10 for detecting the density of the toner, use is made of one utilizing the inductance of a coil to detect any change in the magnetic permeability of the developer as previously described.

The construction in the present embodiment and the effect of the construction will now be described in detail.

The relation between the half length of the detecting surface of the inductance detecting sensor 10 used in the present embodiment in a plane perpendicular to the rotary shaft of the second screw 5 and the outermost surface of the spirally shaped second screw 5 which is a small-diametered agitating member disposed near the sensor 10 is set so as to satisfy the following three expressions:

$$0\ (m) < \mathrm{Dmin} \leqq 1\times10^{-3}(m) \quad (1)$$

Figure 3:
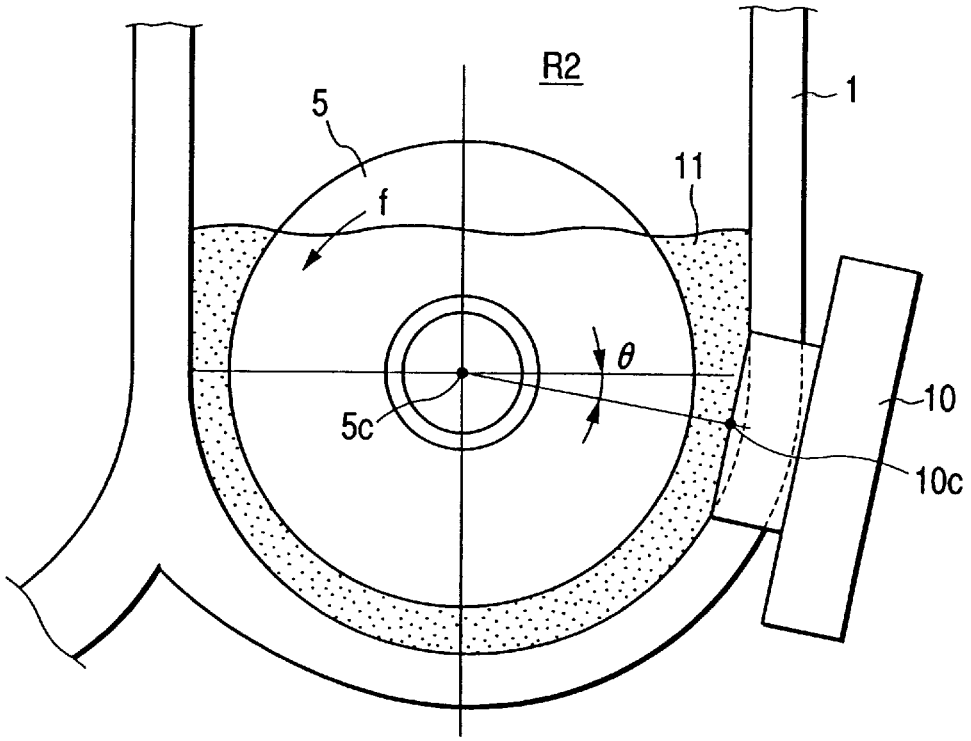
FIG. 3 is an illustration for illustrating a relation between an inductance detecting sensor according to the present invention and a screw.

Dmin: the nearest distance (m) between the outermost surface of the agitating member and the detecting surface of the sensor $$0.4 \leqq r/R \leqq 0.75 \quad (2)$$

r: the half length (m) of the detecting surface of the sensor in a plane perpendicular to the rotary shaft of the agitating member, or when a substantially circular sensor is used, the radius (m) of the detecting surface of the sensor R: the outermost rotation radius (m) of the agitating member $$-35^\circ \leqq \theta \leqq +20^\circ \quad (3)$$

θ: the angle at which as shown in FIG. 3, the central point 10*c* of the detecting surface of the inductance detecting sensor 10 in a plane perpendicular to the rotational center axis 5*c* of the agitating member 5 is in the first or fourth quadrant in a coordinates space having the rotational center axis 5*c* as the origin, and which is formed between a straight line passing through the rotational center axis 5*c* and the central point 10*c* of the inductance detecting sensor and a horizontal axis passing through the rotational center axis 5*c* (being in the first quadrant is (+) and being in the fourth quadrant is (−))

Satisfying the above expressions (1) and (2), preferably (1), (2) and (3), is effected when the rotation diameter of the second screw 5 is as small as 10 to 16 mm, that is, the rotation radius thereof is as small as $5.0\times10^{-3}$ (m) to $8.0\times10^{-3}$ (m). The reasons are that when the rotation diameter of the second screw 5 is sufficiently large as compared with the diameter of the detecting surface of the sensor 10, the dead space in the gap between the second screw 5 and the sensor 10 is small and a force caused by the rotation of the second screw 5 for conveying the developer is strong so that the developer is difficult to stagnate, and that if the rotation diameter of the screw is large, it is possible to make the bulk height of the developer (the surface of the developer) in that portion great and the degree of freedom of the disposed position of the sensor installed on the side in the direction of height is increased.

According to our detailed experiment, if in Expression (1), Dmin is below the above-mentioned range, the screw and the sensor contact with each other, and this results in the deterioration of the developer, an increase in the torque of the screw and the trouble of the sensor. Also, if Dmin is over the above-mentioned range, the dead space between the second screw 5 and the sensor 10 will be too wide and a detection error will occur even if Expressions (2) and (3) are satisfied.

If in Expression (2), r/R is below the above-mentioned range, the detecting surface of the sensor will become too small, thus bringing about a reduction in the absolute output, and if r/R is over the above-mentioned range, the detecting surface of the sensor relative to the second screw will become too large and the wrong detecting operation of the sensor by an increase in the dead space will become liable to occur.

Expression (3) is an expression which prescribes the positional relation between the second screw 5 and the sensor 10 in the direction of height.

If as shown in FIG. 3, in a plane perpendicular to the rotational center axis 5*c* of the second screw 5, the central point 10*c* of the detecting surface of the inductance detecting sensor 10 is in the fourth quadrant in the coordinates space having the above-mentioned rotational center axis 5*c* as the origin and the angle e formed by a straight line passing through the rotational center axis 5*c* and the central point 10*c* of the inductance detecting sensor 10 and a horizontal line passing through the rotational center axis 5*c* is within the range of Expression (3), the sensor will substantially always be covered with the developer in the direction of height of the sensor from the relations among the screw, the sensor and the surface of the developer in the present embodiment. However, if the angle θ is over the above-mentioned range, particularly when T/C is low under high humidity environment, the uppermost surface of the sensor will be located above the uppermost surface of the developer, and that portion of the sensor with which the developer is not in contact will detect the magnetic permeability of the space, and this will cause the phenomenon that the detection output decreases sharply.

On the other hand, as previously described, the developer present in the gap between the lower portion of the screw and the inner wall surface near the bottom of the container is somewhat low in flow speed as compared with the upper portion and is liable to stagnate particularly under high humidity environment. Consequently, if the angle θ is below the range of Expression (3), the detecting surface of the sensor will hang over this portion and the output accuracy will be reduced.

That is, in a system wherein the screw which is an agitating member is downsized in diameter with the downsizing of the developing device and the T/C ratio of the developer is detected by the use of the inductance detecting sensor, satisfying Expressions (1) and (2), preferably (1), (2) and (3), becomes effective for the stabilization of the T/C ratio.

Figure 4:
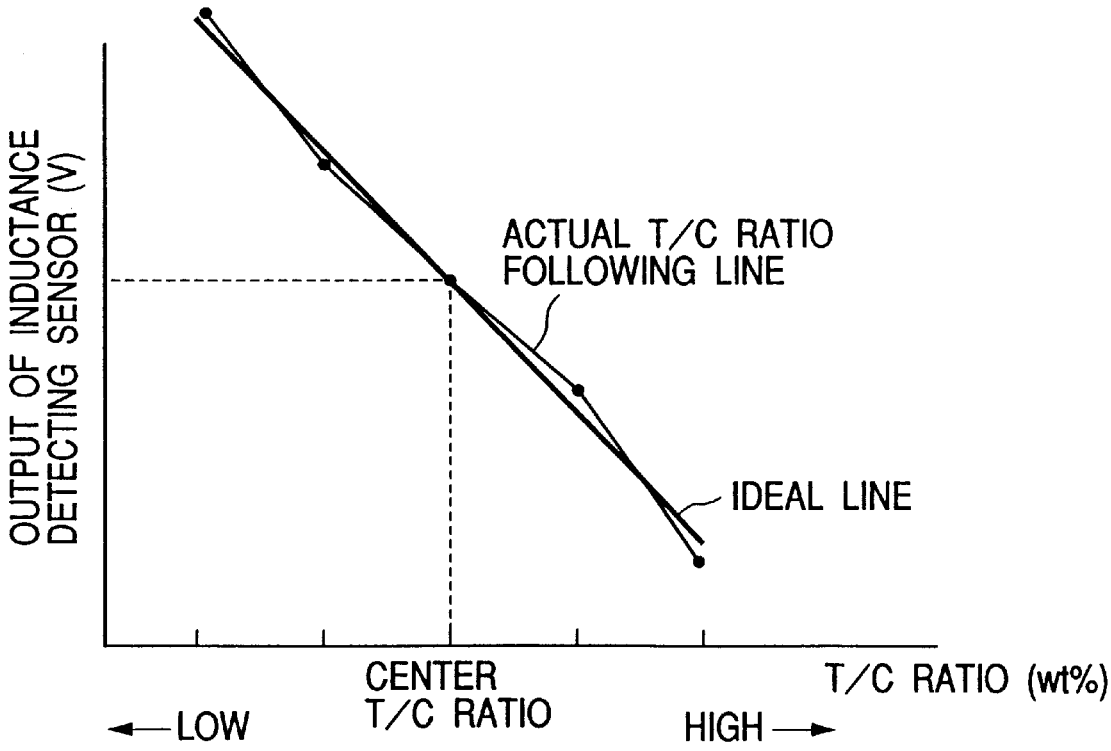
FIG. 4 is a graph showing a relation between a T/C ratio and an output of an inductance detecting sensor in a first embodiment of the present invention.

The condition of the screw and the inductance detecting sensor used in the present embodiment will hereinafter be described. Also, a graph showing the relation between the output of the inductance detecting sensor and the actual T/C ratio when under this condition, a reference T/C ratio developer was put into the developing container and was actually consumed and supplied is shown in FIG. 4.

Figure 5:
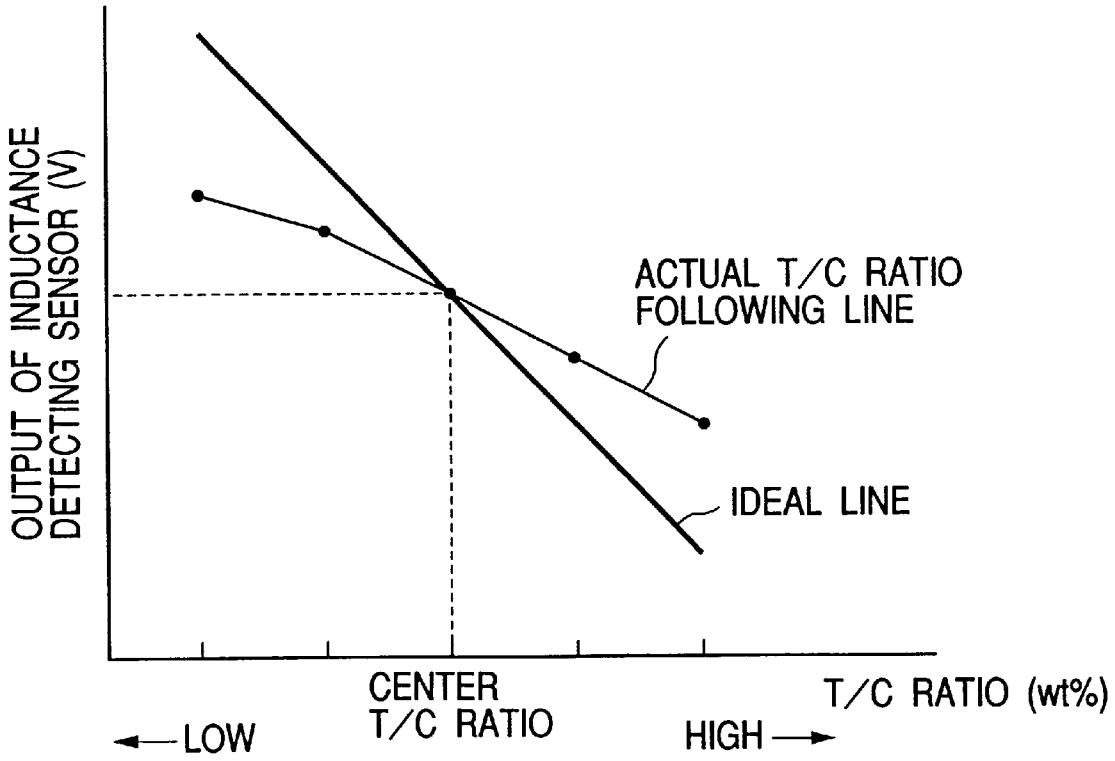
FIG. 5 is a graph showing a relation between a T/C ratio and an output of an inductance detecting sensor in a comparative example relative to the first embodiment of the present invention.

It will be seen that the detection by the inductance detecting sensor is accurately effected for a change in the T/C ratio of the developer in the developing container. A graph of the relation among the condition of a comparative example to the present embodiment and the output of the sensor and the T/C ratio is shown in FIG. 5. It will be seen that the output sensitivity of the sensor is reduced particularly on the side on which the T/C ratio is low. At this time, the uppermost surface of the developer was located below the uppermost surface of the sensor.

The conditions of the agitating members and the toner density detecting sensors in the present embodiment and the comparative example are as follows.

[Present Embodiment]

agitating member: a spirally shaped screw having the outermost rotation radius $7.0\times10^{-3}$ m toner density detecting sensor: inductance sensor, detecting surface . . . circular, radius $5.0\times10^{-3}$ m, disposed on a side of the developing container, and opposed to the screw, θ of Expression (3)=−7.5°, the shortest distance between the agitating member and the sensor: $0.5\times10^{-3}$ m.

In the above-described construction, $$Dmin=0.5\times10^{-3}\ m,\ r/R=0.71.$$

[Comparative Example]

agitating member: a spirally shaped screw, the outermost rotation radius $6.0\times10^{-3}$ m toner density detecting sensor: inductance sensor, detecting surface . . . circular, radius $4.0\times10^{-3}$ m, disposed on a side of the developing container, and opposed to the screw, θ of Expression (3)=−25°, the shortest distance between the agitating member and the sensor: $0.5\times10^{-3}$ m.

In the above-described construction, Dmin=$0.5\times10^{-3}$ m and r/R=0.67, which are outside the ranges of the present invention. As the result, as shown in FIG. 5, the output sensitivity of the sensor is reduced and the accurate detection of the T/C ratio is impossible.

[Second Embodiment]

A second embodiment of the present invention will now be described. The features of this embodiment are the quality and shape of the toner of the two-component developer used in the construction of the first embodiment.

The non-magnetic toner used in the present embodiment is a spherical toner, and in the present embodiment, a monomer composition comprising a coloring agent and a charge controlling agent added to a monomer of the polymerizing method was suspended and polymerized in a water based medium to thereby obtain spherical toner particles. The producing method is not limited to the above-described method, but the spherical toner particles may be produced by the emulsion polymerization method or the like, and other additives may be contained.

As regards the shape coefficient of the spherical polymerized toner obtained by this producing method, SF-1 is 100 to 140 and SF-2 is 100 to 120. As regards these SF-1 and SF-2, values obtained by 100 particles of toner being sampled at random by the use of Hitachi Works Ltd. FE-SEM (S-800), and the image information thereof being introduced into and analyzed by an image analyzing apparatus (Lusex 3) produced by Nicolet Japan Corporation through an interface, and calculated from the following expressions were defined as shape coefficients SF-1 and SF-2 in the present invention.

$$SF\text{-}1=\{(MXLNG)^2/AREA\}\times(\pi/4)\times100$$

$$SF\text{-}2=\{(PERI)^2/AREA\}\times(\pi/4)\times100$$

(MXLNG: absolute maximum length,

AREA: toner projected area,

PERI: peripheral length)

The above-mentioned SF-1 indicates the degree of sphericity, and if it is greater, it gradually becomes unstable from sphericity. SF-2 indicates the degree of unevenness, and if it is greater, the unevenness of the surface area becomes remarkable.

To the shape coefficient of the above-described spherical polymerized toner, the shape coefficient of the conventional crushed toner is such that SF-1 is 180 to 220 and SF-2 is 180 to 200 and therefore, it will be seen that as compared with the conventional crushed toner, the shape of the toner particles of the spherical polymerized toner is approximate to a circle. This spherical polymerized toner, as compared with the conventional crushed toner, is small in the variation rate of the shape coefficient of toner particles for the deterioration of the developer, and the change in the shape coefficient resulting from the agitation of the developer and the compression of the developer occurring when the developing device is operated for 5 hours is such that in the case of the crushed toner, SF-1 is 120 to 150 and SF-2 is 120 to 140, thus becoming approximate to a spherical shape, whereas in the case of the spherical polymerized toner, SF-1 is 100 to 120 and SF-2 is 100 to 120, thus being very little varied.

This shows that the uneven surface layer is scraped off by the friction by the contact between the carrier particles or toner particles by the agitation of the crushed toner and the crushed toner approximates to a spherical shape and therefore the change in its shape is great and the spherical polymerized toner originally approximate to a circle has few factors for a change in its shape relative to the crushed toner and thus, the change in its shape is small. From the above-described fact, the crushed toner is great in the change in the shape of toner particles and consequently, is also great in the rate of change in the area of contact between the developers, and is also great in the changes in percentage of void and bulk density. In contrast, the spherical polymerized toner is small in the change in the shape of toner particles and therefore is also small in the change in bulk density.

Accordingly, by the spherical polymerized toner being used in addition to the above-mentioned three expressions of the present invention, the accuracy of the inductance detecting sensor can be more stabilized in the early stage and latter half of image formation.

[Third Embodiment]

A third embodiment of the present invention will now be described with reference to FIG. 6. This embodiment is characterized in that the quality and property of the carrier are changed to thereby suppress a change in toner charging amount relative to the T/C ratio and a change in toner charging amount by the environment, and as the result, suppress the fluctuation of the surface of the developer and further stabilize the detection accuracy of the inductance detecting sensor.

Figure 6:
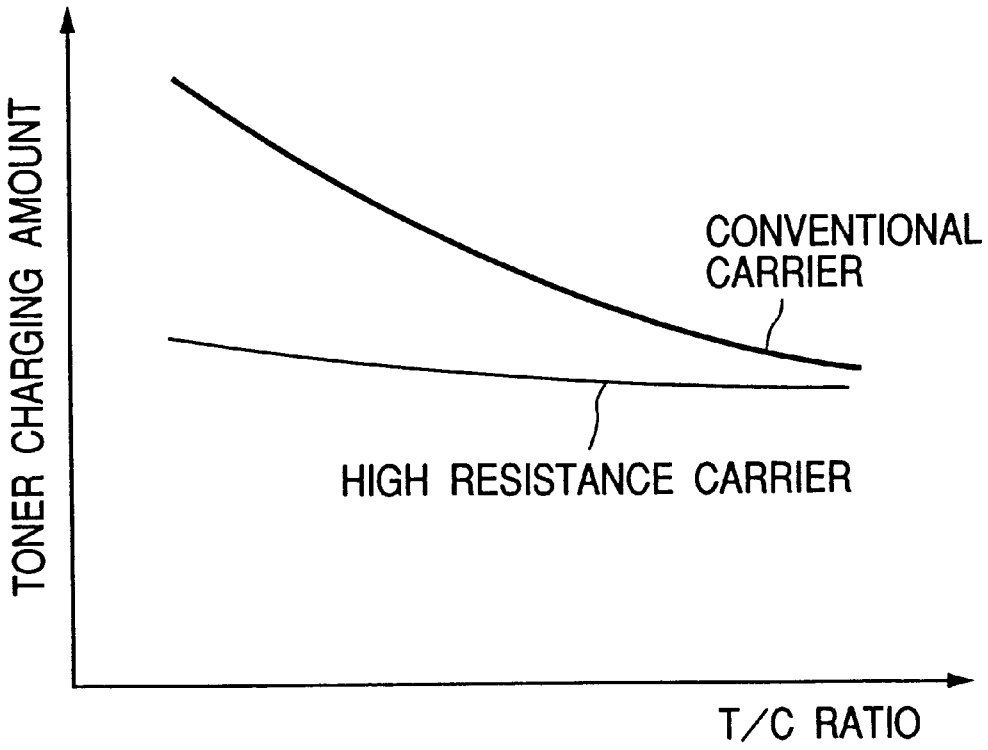
FIG. 6 is a graph showing a relation between a toner charging amount and a T/C ratio when use is made of a high resistance carrier according to a third embodiment of the present invention and a conventional carrier.

FIG. 6 shows changes in toner charging amount for changes in the T/C ratio of the conventionally used ferrite based magnetic carrier and a carrier of high resistance in the present embodiment which could suppress the amount of change in triboelectricity.

It will be seen that as compared with the conventional ferrite based magnetic carrier, the magnetic carrier of the present embodiment is small in the change in toner charging amount. We have considered as follows for this phenomenon. The high resistance carrier of the present embodiment and the ferrite based magnetic carrier differ in their shape coefficient from each other, and in the high resistance carrier, SF-1 is 140 to 180 and SF-2 is 100 to 120, whereas in the ferrite based magnetic carrier, SF-1 is 140 to 180 and SF-2 is 145 to 185 and thus, the surface layer is uneven and therefore, in the range of the T/C ratio of which the comparative measurement was effected, the ferrite based magnetic carrier is wider in the area of contact with the toner and as the result, is higher in the triboelectricity imparting property by the contact with the toner and also, is lower in the resistance of the carrier itself and therefore is small in the accumulation of charges in the carrier and is difficult to saturate. However, when the T/C ratio becomes high, the carrier covering area by the toner becomes high and the area of contact between the toner and the carrier decreases and therefore, the toner charging amount becomes lower than when the T/C ratio is low. In contrast, the high resistance carrier is as high as $1\times10^{10}$ to $1\times10^{14}$ Ω.cm in the specific resistance of the carrier itself and the charges imparted by the contact with the toner are accumulated therein and therefore, the toner charging amount is easy to saturate. Consequently, it is considered that even if the T/C ratio changes, the change in the saturated toner charging amount of the carrier is small and therefore the change in the toner charging amount is small.

If as described above, the change in toner charging amount for the change in the T/C ratio can be suppressed, a system in which the change in the bulk density of the developer (the change in the surface of the developer near the sensor) is smaller can be achieved and by the combination of the present embodiment with the first embodiment, the more accurate custody of the T/C ratio can be accomplished. Or there is the effect that the optimum ranges of the three expressions in the first embodiment become wider and the degree of freedom of the design of the developing device heightens.

We produced the above-described high resistance carrier by polymerizing a resin magnetic carrier comprising binder resin, a magnetic metal oxide and a non-magnetic metal oxide, but if the change in toner charging amount can be suppressed by other manufacturing method, that carrier may be used.

[Fourth Embodiment]

Figure 7:
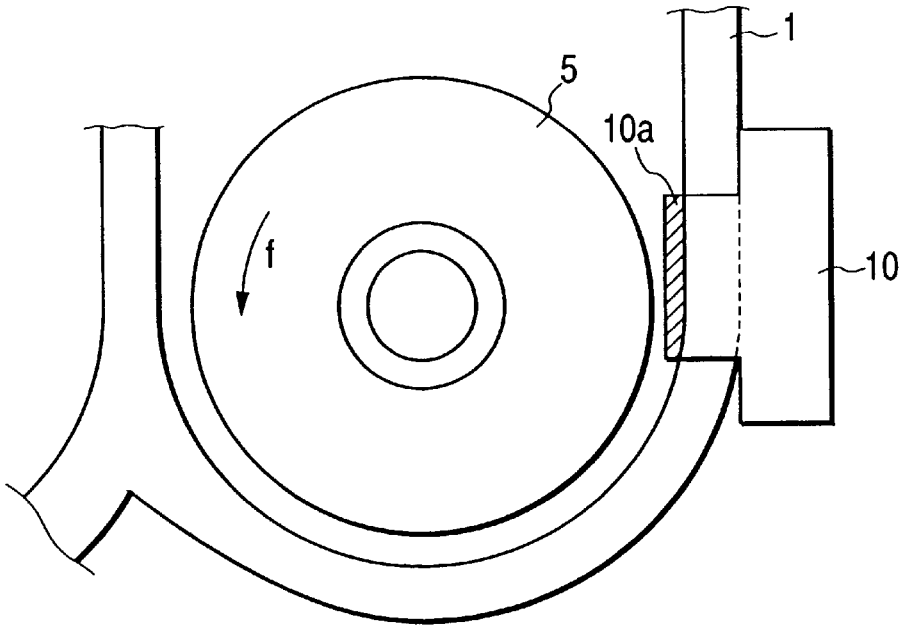
FIG. 7 is an enlarged view schematically showing constructions of an inductance detecting sensor and a screw in a fourth embodiment of the present invention.

A fourth embodiment of the present invention will now be described with reference to FIG. 7.

The feature of this embodiment is that the three expressions of the present invention are satisfied and yet the sensor surface 10*a* of the toner density detecting sensor 10 is protruded inwardly of the wall surface of the developing container 1 to thereby decrease the dead space. As the result, it becomes possible to simply narrow the shortest distance between the sensor 10 and the second screw 5 which is an agitating member, and the detection accuracy of the sensor can be more improved.

The conditions of the present embodiment will be shown below.

agitating member: a spirally shaped screw, the outermost rotation radius $7.0\times10^{-3}$ m, toner density detecting sensor: inductance sensor, detecting surface . . . circular, radius $4.0\times10^{-3}$ m, disposed on a side of the developing container and opposed to the second screw, protruded by $0.5\times10^{-3}$ m from the inner side of the container, θ of Expression (3)=+15° the shortest distance between the agitating member and the sensor: $3.0\times10^{-3}$ m.

In the above-described construction, $$\mathrm{Dmin}=0.2\times10^{-3}\ m \text{ and } r/R=0.57.$$

[Fifth Embodiment]

A fifth embodiment of the present invention will now be described.

The relation between the half length of the detecting surface of the inductance detecting sensor 10 used in this embodiment in a plane perpendicular to the rotary shaft of the second screw 5 and the outermost surface of the spirally shaped second screw 5 which is a small-diametered agitating member disposed near the sensor 10 is set so as to satisfy the following three expressions:

$$0(m)<\mathrm{Dmin}\leqq1\times10^{-3}(m) \quad (1)$$

Dmin: the shortest distance (m) between the outermost surface of the agitating member and the detecting surface of the sensor $$0.4 \leqq r/R \leqq 0.75 \quad (2)$$

r: the half length (m) of the detecting surface of the sensor in a plane perpendicular to the rotary shaft of the agitating member, or when a substantially circular sensor is used, the radius (m) of the detecting surface of the sensor R: the outermost rotation radius (m) of the agitating member $$0.6 \leqq \text{Dmin/Dmax} \leqq 1.0 \quad (3)$$

Dmax: the longest distance (m) between the outermost surface of the agitating member and the detecting surface in a direction perpendicular to the detecting surface Satisfying the above-mentioned Expressions (1) and (2), preferably (1), (2) and (3), is effective when the rotation diameter of the second screw 5 is as small as 10 to 16 mm. The reason is that when the rotation diameter of the second screw 5 is sufficiently large as compared with the diameter of the detecting surface 10*a* of the sensor 10, the dead space in the gap between the second screw 5 and the sensor 10 is small and the developer conveying force resulting from the rotation of the second screw 5 is strong and it is difficult for the developer to stagnate.

According to our detailed experiment, if in Expression (1), Dmin is below the above-mentioned range, the screw and the sensor contact with each other, thus resulting in the deterioration of the developer, an increase in the screw torque and the trouble of the sensor. Also, if Dmin is over the above-mentioned range, the dead space between the second screw 5 and the sensor 10 will be too wide and a detection error will occur even if Expressions (2) and (3) are satisfied.

If in Expression (2), r/R is below the above-mentioned range, the detecting surface 10*a* of the sensor becomes too small, thus bringing about a reduction in the absolute output, and if r/R is over the above-mentioned range, the detecting surface 10*a* relative to the second screw becomes too large and the wrong detecting operation of the sensor due to an increase in the dead space becomes liable to occur.

Also, Expression (3) prescribes the range of the unevenness of the gap between the second screw 5 and the sensor 10, and if the Dmin/Dmax is below the above-mentioned range, it means that the unevenness and inclination of the gap are great, and irregularity becomes liable to occur in the flow speed of the developer in the above-mentioned gap and the wrong detecting operation of the sensor becomes more liable to occur. The condition of the screw and the inductance detecting sensor used in the present embodiment will be described below.

If the construction satisfied the above-mentioned Expressions (1) and (2), preferably (1), (2) and (3), the detection by the inductance detecting sensor was accurately effected for any change in the T/C ratio of the developer in the developing container.

Also, the conditions of the agitating member and the toner density detecting sensor in the present embodiment are as follows.

agitating member: a spirally shaped screw, the outermost rotation radius $7.0\times10^{-2}$ m toner density detecting sensor: inductance sensor, detecting surface . . . circular, radius $0.5\times10^{-2}$ m, disposed on a side of the developing container and opposed to the screw the shortest distance between the agitating member and the sensor: $0.5\times10^{-3}$ m, the longest distance: $0.8\times10^{-3}$ m In the above-described construction, $$\text{Dmin}=0.5\times10^{-3}\ m,\ r/R=0.71 \text{ and Dmin/Dmax}=0.63$$

[Sixth Embodiment]

Figure 8:
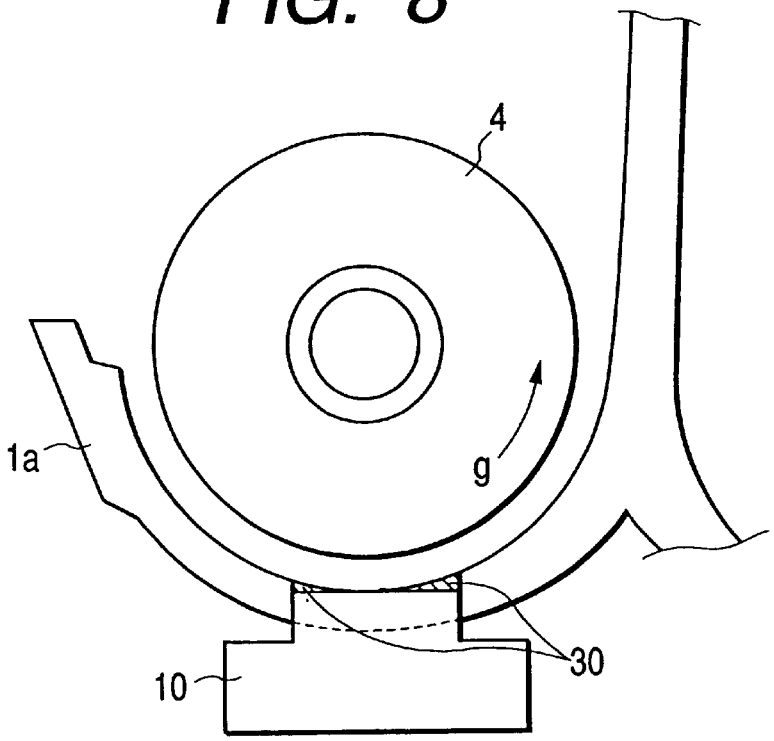
FIG. 8 is an enlarged schematic cross-sectional view showing a positional relation between an agitating member and a sensor in a sixth embodiment of the present invention.

A sixth embodiment of the present invention will now be described with reference to FIG. 8.

The sensor 10 in this embodiment is disposed near the agitating member 4 and on the bottom surface of the developing container, and that portion 30 of the detecting surface 10*a* thereof which does not follow the shape of the wall surface of the developing container in the developing device used has its surface worked so that the developer may not contact with it. Specifically, that portion may preferably be buried in a material 30 such as a mold. As the result, the dead space decreases sharply and the creation of the stagnant developer is prevented, and the detection of the T/C ratio by the inductance detecting sensor becomes more highly reliable. The shape of the detecting surface is substantially circular even if it is worked. The conditions of the present embodiment will be described below.

agitating member: a spirally shaped screw, the outermost rotation radius $0.7\times10^{-2}$ m toner density detecting sensor: inductance sensor, detecting surface . . . circular, radius $0.5\times10^{-2}$ m It is disposed on the bottom surface of the developing container and opposed to the screw, and that portion thereof which does not follow the shape of the container is buried in a mold. the shortest distance between the agitating member and the sensor: $0.5\times10^{-3}$ m, the longest distance: $0.6\times10^{-3}$ m.

In the above-described construction, $$\text{Dmin}=0.3\times10^{-3}\ m,\ r/R=0.71 \text{ and Dmin/Dmax}=0.83.$$

[Seventh Embodiment]

Figure 9:
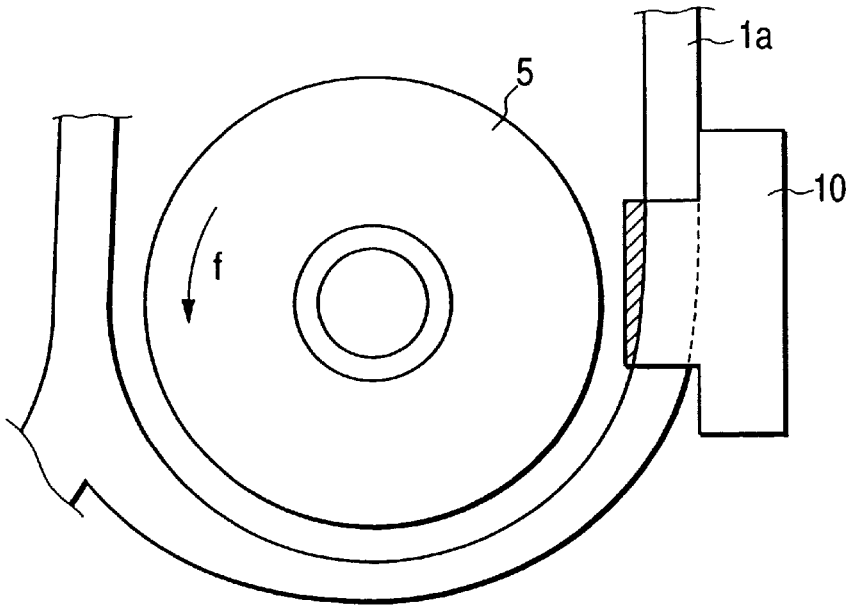
FIG. 9 is an enlarged schematic cross-sectional view showing a positional relation between an agitating member and a sensor in a seventh embodiment of the present invention.
Figure 10:
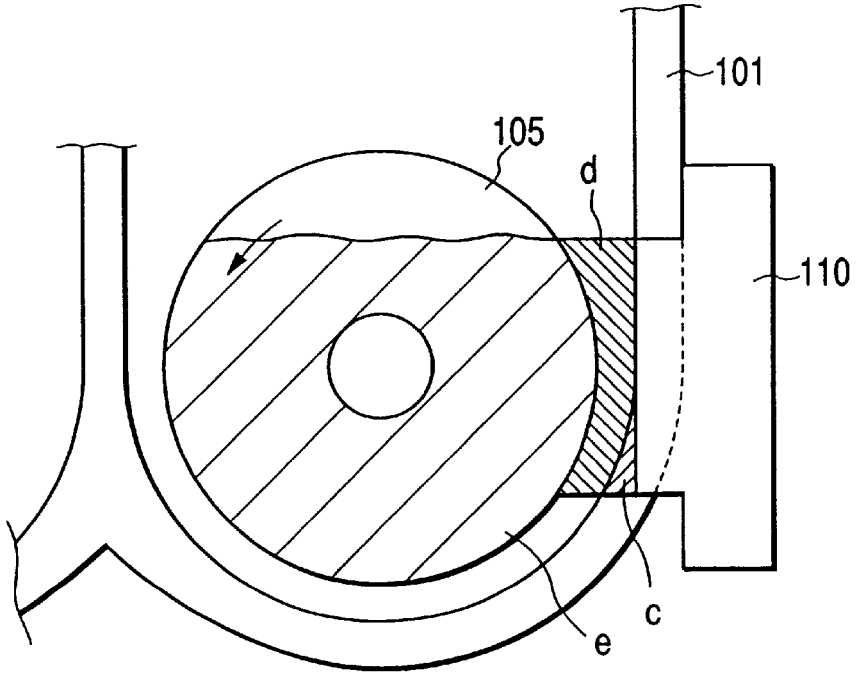
FIG. 10 schematically shows a disposition of an inductance detecting sensor.
Figure 11:
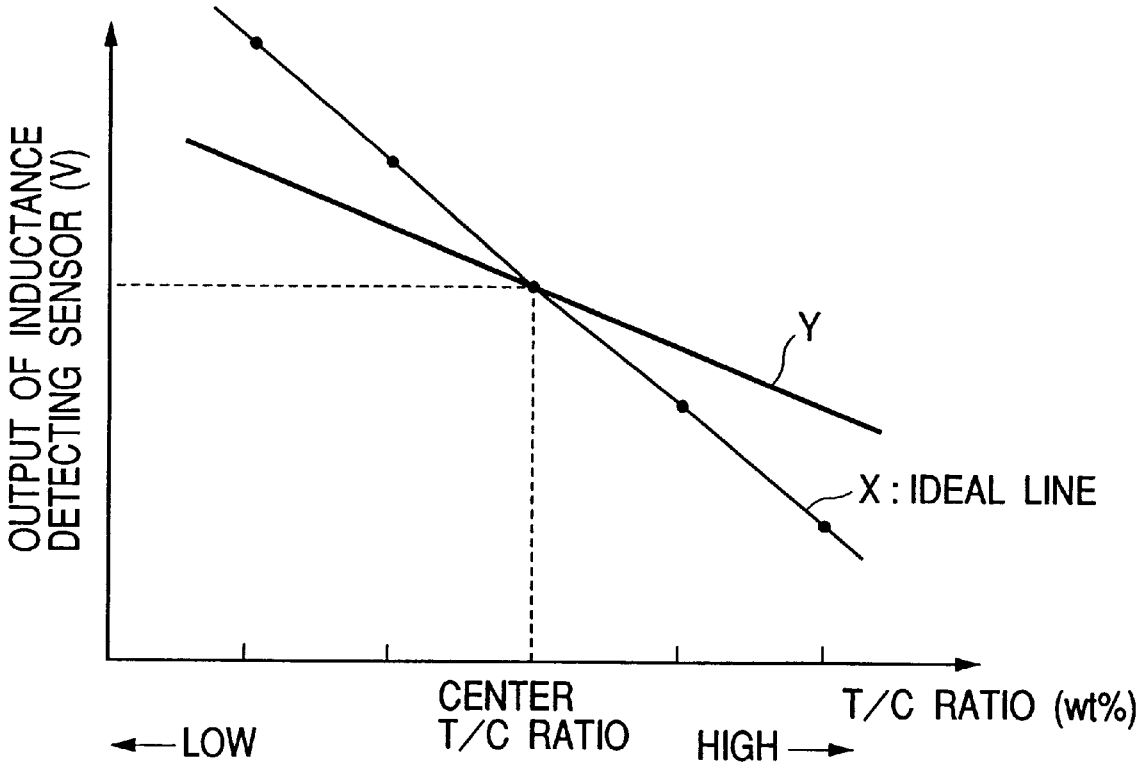
FIG. 11 is a graph showing a relation between a T/C ratio and an output of the inductance detecting sensor.
Figure 12:
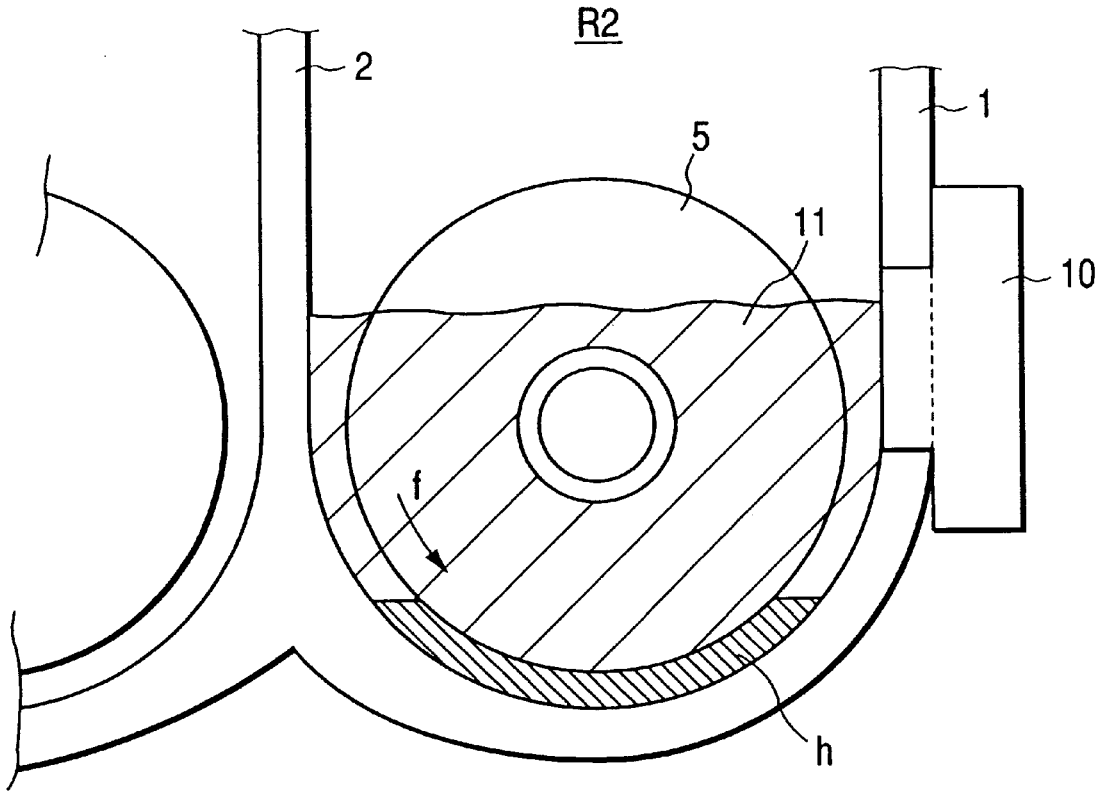
FIG. 12 is an enlarged view showing a state of a developer near the inductance detecting sensor.

A seventh embodiment of the present invention will now be described with reference to FIG. 9.

The feature of this embodiment is that the three expressions of the fifth embodiment are satisfied and yet the detecting surface of the toner density detecting sensor is protruded inwardly of the wall surface of the developing container to thereby decrease the dead space. As the result, it becomes possible to simply narrow the shortest distance between the sensor and the agitating member, and the detection accuracy of the sensor can be more improved.

The conditions of the present embodiment will be shown below.

agitating member: a spirally shaped screw, the outermost rotation radius $0.7\times10^{-2}$ m toner density detecting sensor: inductance sensor, detecting surface . . . circular, radius $0.4\times10^{-2}$ m, disposed on a side of the developing container, and opposed to the screw, protruded by $0.5\times10^{-3}$ m from the inner side of the container, the shortest distance between the agitating member and the sensor: $0.3\times10^{-3}$ m, the longest distance: $0.5\times10^{-3}$ m.

In the above-described construction, $$\text{Dmin}=0.2\times10^{-3}\ m,\ r/R=0.57 \text{ and Dmin/Dmax}=0.6.$$

As is apparent from the foregoing description, the developing device and the image forming apparatus according to the present embodiment have an agitating member disposed in the developing container to circulate and agitate a two-component developer, and toner density detecting means having a substantially circular detecting surface disposed outside and in proximity to the outermost surface of the agitating member for detecting a change in the toner density of the two-component developer as a change in magnetic permeability, and when the outermost radius R (m) of the agitating member is in the range of $5.0\times10^{-3}\leqq R\leqq8.0\times10^{-3}$ and Dmin is defined as the shortest distance (m) between the outermost surface of the agitating member and the detecting surface and r is defined as the radius of the detecting surface and R is defined as the outermost rotation radius (m) of the agitating member, $0<Dmin\leqq1\times10^{-3}$ and $0.4\leqq r/R\leqq0.75$ are satisfied, whereby the downsizing of the apparatus and an improvement in the reliability of the toner density detecting means can be made compatible, and the relation between the agitating member and the toner density detecting means is optimized, and the detection accuracy of the toner density detecting means can be improved and further, it has become possible to maintain the stability of images.

What is claimed is:

1. A developing device having:

(a) a developer bearing member for bearing thereon a developer having toner and carrier and conveying the developer to a developing area;

(b) an agitating member for agitating said developer, a rotation radius R (m) of said agitating member being $5.0\times10^{-3}$ (m)$\leqq R\leqq8.0\times10^{-3}$ (m); and (c) density detecting means for detecting a density of the toner in said developer, said density detecting means detecting any change in the density of the toner as a change in a magnetic permeability of said developer:

wherein when a shortest distance between an outermost surface of said agitating member and a detecting surface of said density detecting means is defined as Dmin (m) and a half length of the detecting surface of said density detecting means in a plane perpendicular to a rotary axis of said agitating member is defined as r, 0 (m)$<Dmin\leqq1.0\times10^{-3}$ (m) and $0.4\leqq r/R\leqq0.75$.

2. A developing device according to claim 1, wherein in the plane perpendicular to the rotary axis of said agitating member, a central point of said detecting surface is in a first quadrant or a fourth quadrant in a coordinate space having said rotary axis as an origin.

3. A developing device according to claim 2, wherein an angle θ formed by a straight line passing through said rotary axis and the central point of said detecting surface and a horizontal line passing through said rotary axis is $-35°\leqq\theta\leqq+20°$ when being in the first quadrant is + (plus) and being in the fourth quadrant is − (minus).

4. A developing device according to claim 1, wherein when in the plane perpendicular to the rotary axis of said agitating member, a longest distance between the outermost surface of said agitating member and the detecting surface of said density detecting means in a direction perpendicular to the detecting surface of said density detecting means is defined as Dmax (m), $0.6\leqq Dmin/Dmax\leqq1.0$.

5. A developing device according to claim 1, wherein said toner is non-magnetic and said carrier is magnetic.

6. A developing device according to claim 5, wherein said non-magnetic toner is a toner produced by a polymerizing method of which a shape coefficient SF-1 is within a range of 100 to 140 and SF-2 is within a range of 100 to 120.

7. A developing device according to claim 5, wherein said magnetic carrier is high resistance carrier produced from resin magnetic carrier comprising binder resin, a magnetic metal oxide and a non-magnetic metal oxide by a polymerizing method.

8. A developing device according to claim 7, wherein a shape coefficient SF-1 of said magnetic carrier is within a range of 100 to 140 and SF-2 is within a range of 100 to 120.

9. A developing device according to claim 5, wherein a specific resistance of said magnetic carrier is within a range of $1\times10^{10}$ Ω.cm to $1\times10^{14}$ Ω.cm.

10. A developing device according to claim 1, wherein said agitating member is of a spiral shape.

11. A developing device according to claim 1, wherein the detecting surface of said density detecting means protrudes from an inner wall surface of a developing container to an inside of the developing container.

12. A developing device according to claim 1, wherein a portion of the detecting surface of said density detecting means which does not follow a shape of a wall surface of a developing container is worked so that the developer may not contact with the portion.

13. An image forming apparatus having:

(1) an image bearing member bearing a latent image thereon; and (2) a developing device for developing the latent image formed on said image bearing member, said developing device having:

(a) a developer bearing member for bearing thereon a developer having toner and carrier and conveying the developer to a developing area;

(b) an agitating member for agitating said developer, a rotation radius R (m) of said agitating member being $5.0\times10^{-3}$ (m)$\leqq R\leqq8.0\times10^{-3}$ (m); and (c) density detecting means for detecting a density of the toner in said developer, said density detecting means detecting any change in the density of the toner as a change in a magnetic permeability of said developer;

wherein when a shortest distance between an outermost surface of said agitating member and a detecting surface of said density detecting means is defined as Dmin (m) and a half length of the detecting surface of said density detecting means in a plane perpendicular to a rotary axis of said agitating member is defined as r, 0 (m)$<Dmin\leqq1.0\times10^{-3}$ (m) and $0.4\leqq r/R\leqq0.75$.

14. An image forming apparatus according to claim 13, wherein in the plane perpendicular to the rotary axis of said agitating member, a central point of said detecting surface is in a first quadrant or a fourth quadrant in a coordinate space having said rotary axis as an origin.

15. An image forming apparatus according to claim 14, wherein an angle θ formed by a straight line passing through said rotary axis and the central point of said detecting surface and a horizontal line passing through said rotary axis is $-35°\leqq\theta\leqq+20°$ when being in the first quadrant is + (plus) and being in the fourth quadrant is − (minus).

16. An image forming apparatus according to claim 13, wherein when in the plane perpendicular to the rotary axis of said agitating member, a longest distance between the outermost surface of said agitating member and the detecting surface of said density detecting means in a direction perpendicular to the detecting surface of said density detecting means is defined as Dmax (m), $0.6<Dmin/Dmax\leqq1.0$.

17. An image forming apparatus according to claim 13, wherein said toner is non-magnetic and said carrier is magnetic.

18. An image forming apparatus according to claim 17, wherein said non-magnetic toner is a toner produced by a polymerizing method of which a shape coefficient SF-1 is within a range of 100 to 140 and SF-2 is within a range of 100 to 120.

19. An image forming apparatus according to claim 17, wherein said magnetic carrier is high resistance carrier produced from resin magnetic carrier comprising binder resin, a magnetic metal oxide and a non-magnetic metal oxide by a polymerizing method.

20. An image forming apparatus according to claim 19, wherein a shape coefficient SF-1 of said magnetic carrier is within a range of 100 to 140 and SF-2 is within a range of 100 to 200.

21. An image forming apparatus according to claim 17, wherein a specific resistance of said magnetic carrier is within a range of $1\times10^{10}$ Ω.cm to $1\times10^{14}$ Ω.cm.

22. An image forming apparatus according to claim 13, wherein said agitating member is of a spiral shape.

23. An image forming apparatus according to claim 13, wherein the detecting surface of said density detecting means protrudes from an inner wall surface of a developing container to an inside of the developing container.

24. An image forming apparatus according to claim 13, wherein a portion of the detecting surface of said density detecting means which does not follow a shape of a wall surface of a developing container is worked so that the developer may not contact with the portion.

25. An image forming apparatus according to claim 14, wherein alternate electric fields are formed in a developing area, and the latent image formed on said image bearing member is visualized by a utilization of said alternate electric fields.

* * * * *

UNITED STATES PATENT AND TRADEMARK OFFICE

CERTIFICATE OF CORRECTION

PATENT NO. : 6,104,892

DATED : August 15, 2000

INVENTOR(S) : Yoshiaki Kobayashi, et al.

It is certified that error appears in the above-identified patent and that said Letters Patent is hereby *corrected as shown below:*

ITEM [57]

Line 5, "(m)<R<8.0x$10^{-3}$ should read --(m ≤R ≤ 8.0 x $10^{-3}$--; and
Line 14, "(m)<Dmin<1.0x$10^{313}$ (m) and 0.4<r/R < 0.75." should read --(m) < Dmin ≤1.0 x $10^{-3}$ (m) and 0.4 ≤ r/R ≤ 0.75.--.

COLUMN 1

Line 20, "to" should be deleted.

COLUMN 4

Line 3, "developers" should read --developer--.

COLUMN 9

Line 6, "e" should read --θ--; and
Line 63, "toner" should read --¶toner--.

UNITED STATES PATENT AND TRADEMARK OFFICE

CERTIFICATE OF CORRECTION

PATENT NO. : 6,104,892

DATED : August 15, 2000

INVENTOR(S) : Yoshiaki Kobayashi, et al.

It is certified that error appears in the above-identified patent and that said Letters Patent is hereby corrected as shown below:

COLUMN 14

Line 32, "the shortest" should read --¶the shortest--.

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*